US006776102B2

(12) United States Patent
Thiesen et al.

(10) Patent No.: US 6,776,102 B2
(45) Date of Patent: Aug. 17, 2004

(54) PROJECTILE BODY

(75) Inventors: Stefan Thiesen, Willich (DE); Dieter Jungbluth, Herschbach (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 10/396,332

(22) Filed: Mar. 26, 2003

(65) Prior Publication Data

US 2004/0020399 A1 Feb. 5, 2004

(30) Foreign Application Priority Data

Mar. 26, 2002 (DE) ..... 102 13 466

(51) Int. Cl.[7] ..... F42B 14/00; F42B 14/02
(52) U.S. Cl. ..... 102/527; 102/526; 102/524
(58) Field of Search ..... 102/524, 526–527

(56) References Cited

U.S. PATENT DOCUMENTS

| | | | | |
|---|---|---|---|---|
| 548,884 A | * | 10/1895 | Maxim | 102/526 |
| 628,106 A | * | 7/1899 | Maxim et al. | 102/527 |
| 642,762 A | * | 2/1900 | Stubbs et al. | 102/526 |
| 4,519,117 A | * | 5/1985 | Gotz et al. | |
| 4,884,508 A | * | 12/1989 | Kruse et al. | 102/524 |
| 5,081,931 A | * | 1/1992 | Frye et al. | 102/524 |
| 6,237,497 B1 | * | 5/2001 | Altenau et al. | 102/524 |
| 6,401,622 B1 | * | 6/2002 | Brinkmann | 102/524 |
| 6,412,419 B1 | * | 7/2002 | Brinkmann | 102/524 |
| 6,536,353 B1 | * | 3/2003 | Fischer et al. | 102/526 |

FOREIGN PATENT DOCUMENTS

| | | |
|---|---|---|
| DE | 446 658 A | 12/1912 |
| DE | 308 537 C | 12/1917 |
| DE | 642 787 C | 3/1937 |
| DE | 0759 533 | 2/1997 |
| DE | 198 18 411 A1 | 11/1999 |
| EP | 0 027 5552 A | 4/1981 |

* cited by examiner

*Primary Examiner*—Michael J. Carone
*Assistant Examiner*—L. Semunegus
(74) *Attorney, Agent, or Firm*—Venable LLP; Stuart I. Smith

(57) ABSTRACT

A projectile body having a groove-shaped recess (2), in which a guide band (3) is disposed. To permit use of a relatively wide guide band (3), while preventing the band from being destroyed as the projectile body (1) passes through the gun barrel, and preventing significant copper-plating of the barrel, the guide band (3) is assembled from two partial guide bands (5, 6), with the relatively narrow, first partial band (5), which faces the base (7) of the projectile, comprising copper or a copper alloy and providing a seal against the propellant gases acting on the projectile rear under high pressure. The second, considerably wider partial guide band (6) essentially comprises plastic, and includes at least one hollow space (11), which lends it adequate deformation reserves with respect to the high surface pressure acting on this partial guide band (6) when the projectile body (1) passes through the barrel.

9 Claims, 1 Drawing Sheet

PROJECTILE BODY

CROSS REFERENCE TO RELATED APPLICATION

This application claims the priority of German Patent Application No. DE 102 13 466.9 filed Mar. 26, 2002, which is incorporated herein by reference.

BACKGROUND OF THE INVENTION

The invention relates to a projectile body having a groove-shaped recess, in which a guide band is disposed.

In large-caliber tank projectiles, established technical requirements often stipulate the use of relatively wide guide bands comprising plastic or copper. It has been seen, however, that wide plastic guide bands can be destroyed because of the high surface pressure accompanying the passage of the respective projectile body through the gun barrel, and therefore cannot perform their intended function. In particular, when guide bands are destroyed, the seal against the propellant gases acting on the rear of the projectile body is inadequate, so the gases can flow past the projectile body in the barrel.

In the use of wide guide bands (i.e., guide bands whose width is ≧30 mm) made of copper or a copper alloy, the rear seal is usually adequate, but the use of these materials frequently results in an undesired copper plating of the inside surface of the gun barrel. While methods of removing copper are known for narrow copper bands (that is, copper bands whose width is <15 mm), the Applicant in unaware of the methods being applicable to wider guide bands. The applicability of these methods would have to be determined through time-consuming experiments.

DE 198 18 411 A1 discloses a projectile body having a groove-shaped recess for a guide band, the band comprising at least two partial guide bands that are disposed one behind the other in the direction of the projectile longitudinal axis. The first partial band, which faces the bottom of the projectile, comprises soft iron, while the second partial guide band is made of copper. The cited application gives no indication of how to resolve the aforementioned problems associated with wide plastic or copper guide bands.

SUMMARY OF THE INVENTION

It is the object of the invention to provide a projectile body having a wide guide band, which is not destroyed when the projectile body passes through the gun barrel and does not cause notable copper-plating of the barrel.

According to the invention, this object generally is achieved by a projectile body having a groove-shaped recess formed in an outer circumferential surface, and a guide band disposed in the groove shaped recess; and wherein: the guide band comprises at least two partial guide bands that are disposed one behind the other in the direction of the longitudinal axis of the projectile body; the first partial guide band, which faces the projectile base, comprises copper or a copper alloy, and its length is smaller than the length of the second partial guide band, which adjoins a front edge of the first partial guide band; the second partial guide band includes a plastic body and a metal sheet support, which is disposed between the plastic body and a groove base of the recess of the projectile body, and is connected in a non-positive lockup to the plastic body; and the second partial guide band includes at least one hollow space that is open to the groove base of the recess of the projectile body. Further, especially advantageous, embodiments of the invention are disclosed and discussed.

The invention is based on the concept of assembling the guide band from two partial guide bands, with the relatively narrow, first partial band, which faces the rear or base of the projectile, comprising copper or a copper alloy and providing a seal against the propellant gases acting on the projectile rear under high pressure. The width of the first partial guide band is selected to prevent notable copper plating. The second, considerably wider partial guide band, which performs the task of actually supporting the projectile body in the gun barrel, essentially comprises plastic, and includes at least one hollow space, which lends it adequate deformation reserves with respect to the high surface pressure acting on the guide band when the projectile body passes through the barrel.

To ensure that the second partial guide band is sufficiently stable, a metal sheet support that faces the groove base of the projectile recess is connected to the plastic body in a non-positive lockup, preferably through injection molding. The hollow space of the second partial guide band can be formed simply by bending the metal sheet support in the region of the hollow space so that it arches toward the outside guide-band surface, then injecting plastic onto the outside of this arched region. This simultaneously establishes the geometry and the position of the hollow space in a simple, low-cost manner.

An advantageous measure for inserting the two partial guide bands as a unit into the recess of the projectile body involves embodying the metal sheet support of the second partial guide band such that it protrudes laterally past the plastic body, so the first guide band can likewise be secured to the sheet support.

Soft iron, which is easily deformed, yet withstands the pressure exerted during the injection of the guide band, has proven advantageous as the material for the metal sheet support. Other metal alloys that are compatible with the projectile body and the copper guide band (electrochemical series) are also acceptable, however.

Further details about and advantages of the invention ensue from the following exemplary embodiment, which is explained in conjunction with figures.

DETAILED DESCRIPTION OF THE INVENTION

Figure 1:
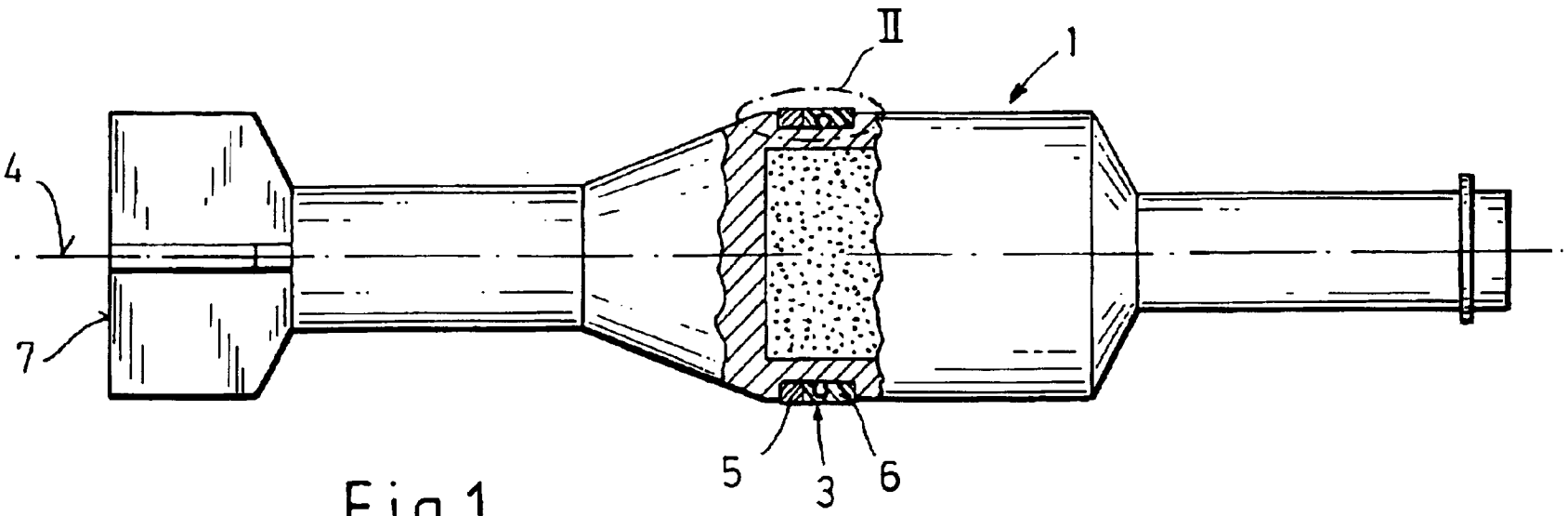
FIG. 1 is a side view, partially in section, of a projectile body according to the invention.

In FIG. 1, the projectile body of a fin-stabilized tank projectile, which is to be fired from smooth-barrel cannons, is represented by 1. The circumferential surface of the projectile body 1 is provided with a groove-shaped recess 2 (FIG. 2) for a guide band 3. The guide band 3 comprises two partial guide bands 5 and 6, which are disposed one behind the other in the direction of the longitudinal axis 4 of the projectile body 1 with the first partial guide band 5 being shorter in the longitudinal direction than the second partial guide band 6.

The relatively narrow, first partial guide band 5 facing the projectile base or rear 7 comprises copper or a copper alloy.

The second partial guide band 6 comprises a plastic body 8 and a metal sheet support 10 that faces the groove base 9 of the recess 2 of the projectile body 1, and to which the plastic body a is connected in a non-positive lockup, for example, through injection molding. The second partial guide band 6 further includes a hollow apace 11, which is open in the direction of the groove base 9 of the recess 2 of the projectile body 1, and is created by the corresponding shaping of the metal sheet support 10 in this region, when forming the partial guide band by injection molding. However, it is understood that the partial guide band 6 with the hollow space 11 can be formed in other ways. Moreover, it is not necessary for the metal support to extent into the recess.

Figure 2:
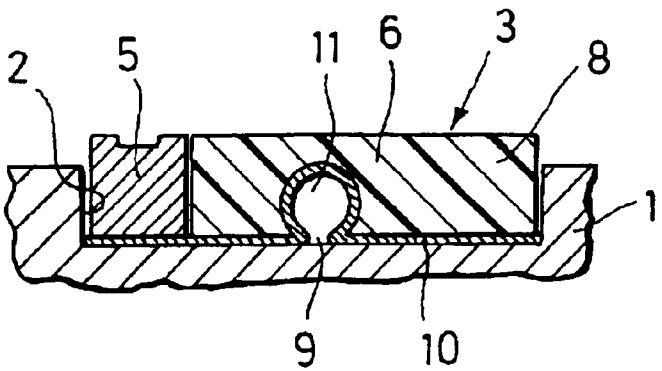
FIG. 2 is an enlarged depiction of the cutout represented by II in FIG. 1.

As can be seen from FIG. 2, the metal sheet support 10 of the second partial guide band 6 protrudes laterally past the plastic body 8 such that the first guide band 5 is likewise disposed on the sheet support 10 and may be connected to it in a non-positive lockup.

Of course, the invention is not limited to the above-described embodiment. For example, instead of only a single hollow space, a plurality of them can be provided in the second partial guide band 6. Moreover, at least one of the two partial guide bands can also be provided with pressure-relief grooves, such as those described in the above-cited document DE 198 18 411 A1.

The guide band 3 has a width of ≧30 mm, and the first partial guide band 5 has a width >15 mm.

The projectile body of the invention may also be a spin-stabilized artillery projectile.

The invention now being fully described, it will be apparent to one of ordinary skill in the art that many changes and modifications can be made thereto without departing from the spirit or scope of the invention as set forth herein.

What is claimed is:

1. A projectile body having a groove-shaped recess formed in an outer circumferential surface and, a guide band disposed in the groove-shaped recess; and wherein:

the guide band comprises at least two partial guide bands that are disposed one behind the other in the direction of the longitudinal axis of the projectile body;

the first partial guide band, which faces the projectile base, comprises copper or a copper alloy, and its length is smaller than the length of the second partial guide band which adjoins a front of the first partial guide band;

the second partial guide band includes a plastic body and a metal sheet support, that is disposed between the plastic body and a groove base of the recess of the projectile body, and that is connected to the plastic body; and, the second partial guide band includes at least one hollow space, which is open to the groove base of the recess of the projectile body.

2. The projective body according to claim 1, wherein the metal sheet support has a bent portion that extends into the hollow space of the plastic body.

3. The projectile body according to claim 2, wherein the bent portion has a shape that conforms to the shape of the hollow space of the plastic body.

4. The projectile body according to claim 1, wherein a part of the metal sheet support of the second partial guide band protrudes laterally past the plastic body in at least a longitudinal direction toward said first partial guide band, and said first guide band is disposed on the protruding part of the metal sheet support.

5. The projectile body according to claim 4, wherein the first partial guide band is connected to the metal sheet support.

6. The projectile body according to claim 1, wherein the metal sheet support comprises deformable soft iron.

7. The projectile body according to claim 1, wherein the entire guide band has a width of ≧30 mm, and the first partial guide band has a width of <15 mm.

8. The projectile body according to claim 1, wherein the metal sheet support is connected to the plastic body by injection molding.

9. The projectile body according to claim 5, wherein the first partial guide band is connected to the metal sheet support by injection molding.

* * * * *